US005702800A

United States Patent [19]

Mihayashi et al.

[11] Patent Number: 5,702,800

[45] Date of Patent: Dec. 30, 1997

[54] ABRASIVE TAPE FOR MAGNETIC INFORMATION READING APPARATUS FOR PHOTOGRAPHIC USE, ABRASIVE TAPE PACKAGE, AND A METHOD FOR CLEANING THE APPARATUS

[75] Inventors: Keiji Mihayashi; Katsumi Ryoke, both of Kanagawa, Japan

[73] Assignee: Fuji Photo Film Co., Ltd., Kanagawa, Japan

[21] Appl. No.: 618,351

[22] Filed: Mar. 19, 1996

[30] Foreign Application Priority Data

Mar. 30, 1995 [JP] Japan ..... 7-100103

[51] Int. Cl.[6] ..... B24D 3/00; B24B 1/00

[52] U.S. Cl. ..... 428/144; 51/295; 360/128; 428/143; 428/148

[58] Field of Search ..... 51/295; 360/128; 428/143, 144, 148, 694 SG

[56] References Cited

U.S. PATENT DOCUMENTS

| | | | |
|---|---|---|---|
| 4,138,229 | 2/1979 | Tadokoro et al. | 51/298 X |
| 5,135,546 | 8/1992 | Sato et al. | 51/295 |
| 5,152,917 | 10/1992 | Pieper et al. | 51/295 |
| 5,314,514 | 5/1994 | Sato | 51/295 |
| 5,456,734 | 10/1995 | Ryoke et al. | 51/295 |

FOREIGN PATENT DOCUMENTS

| | | | |
|---|---|---|---|
| 619057 | 1/1994 | Japan | G03C 3/00 |
| 6148798 | 5/1994 | Japan | G03C 1/765 |
| 7-244825 | 9/1995 | Japan | G11B 5/41 |
| 7270994 | 10/1995 | Japan | G03D 3/00 |

*Primary Examiner*—Daniel Zirker

*Attorney, Agent, or Firm*—Sughrue, Mion, Zinn, Macpeak & Seas, PLLC

[57] ABSTRACT

An abrasive tape for cleaning a magnetic information reading apparatus for photographic use. The tape comprises an abrasive layer including an abrasive and a binder and a support therefor. The support havs a characteristic thickness between 40 μm and 180 μm. An abrasive tape package for the apparatus comprises a cartrigde body, and a spool which is placed inside the cartrigde and rotatably supported by the cartrigde through a shaft. In the package, the spool is wound by the abrasive tape wherein the support has a thickness between 40 μm and 180 μm; the cartrigde has a feed passway for sending out the abrasive tape; and a pair of apparatus abrasive tape retainers are attached to the inside of the both ends of the shaft.

11 Claims, 7 Drawing Sheets

ABRASIVE TAPE FOR MAGNETIC INFORMATION READING APPARATUS FOR PHOTOGRAPHIC USE, ABRASIVE TAPE PACKAGE, AND A METHOD FOR CLEANING THE APPARATUS

BACKGROUND OF THE INVENTION

1. Field of the Invention

The present invention relates to an abrasive tape for a magnetic information reading apparatus for photography, and in particular to an abrasive tape which makes it possible to remove stains adhered to the apparatus and to reduce errors in reading magnetic information. The invention also relates to an abrasive tape package for a magnetic information reading apparatus used for photography, and further relates to a method for cleaning a magnetic information reading apparatus for photography by using the abrasive tape or abrasive tape cartridge.

2. Description of the Related Art

In this technical field, a number of silver halide photographic sensitive materials, for a camera, having a magnetic recording layer have recently been proposed.

For photographic sensitive materials of this type, it is necessary that recorded magnetic information is read precisely, particularly after the materials have undergone a developing process.

However, it has been found that, when the proposed photographic sensitive materials having a magnetic recording layer are subjected to development processing in a large scale for test and research, as in a large laboratory, the following problems occur: When magnetic information is read from the developed photographic sensitive material, reading errors tend to occur in a magnetic information reading apparatus, e.g., a magnetic reading apparatus which is attached to a printer or is in a projecting apparatus which projects developed negative film onto a CRT. Another problem is that stains are deposited on a portion of the apparatus, i.e., the portion which contacts a developed photographic sensitive material when the material transfers inside the apparatus. Stains are also deposited on the photosensitive material.

After research of the cause for errors in reading magnetic information, it has been found that stain substances are adhered to a magnetic head, which contacts a photosensitive material, and that these stain substances are the same as those that are deposited on developed photosensitive materials or on the portion which contacts the photosensitive material when the material is transferred therein. Further it has been speculated that these stain substances are a variety of minerals contained in water used for preparing a developer (for example, calcium ions and magnesium ions), chlorine ions, sulfate ions, silicate ions, dust in air (fiber fragments, etc.), components contained in the magnetic recording layer, gelatin, and so on. It has been also made sure that errors in reading magnetic information could be avoided if these stain substances are removed.

To remove the above-mentioned substances, it may be assumed that abrasive tapes containing an abrasive material is used. Such abrasive tapes have generally been used for regenerating deteriorated magnetic heads of audio and video apparatus and computers. They are also used for abrasing the surfaces of magnetic media such as floppy disk substrates and hard disk substrates; for abrasing surfaces of metals and plastics of office automation apparatus and medical equipment; and for finishing highly technical materials such as ceramic and silicon wafers. Supporting materials for these abrasive tapes are thin films having a thickness between 20 and 30 μm. A wide variety of abrasive tapes are commercially available including, for example, super precision abrasive tapes manufactured by Fuji Photo Film Co., Ltd.

However, these tapes do not have sufficient service life for abrasive tapes used for magnetic information reading apparatus for photosensitive materials. This is because, in these apparatus, pressure applied by magnetic heads to photosensitive materials is stronger than the force applied to ordinary audio and video tapes. Therefore, the tapes are not satisfactory for solving the above problems.

SUMMARY OF THE INVENTION

Accordingly, a first object of the present invention is to provide a highly durable abrasive tape which makes it possible to remove stains adhered to a magnetic information reading apparatus for photographic use and to reduce errors in reading magnetic information. A second object of the present invention is to provide an abrasive tape package in which the abrasive tape is accommodated in a specific cartridge. A third object of the present invention is to provide a method for cleaning a magnetic information reading apparatus for photographic by using the abrasive tape or abrasive tape package.

The present inventors have discovered that stains can be removed from a magnetic information reading apparatus for photographic use and errors in reading magnetic information can be reduced by the use of a tape in which an abrasive-containing abrasive layer is provided on a support having a thickness in a specific range, i.e., having a thickness greater than that of abrasive tapes for other purposes; by a package in which such a tape is accommodated in a specific cartridge; or by a method of cleaning magnetic information reading apparatus for photographic use in which the tape or the tape cartridge is used. The present invention has been accomplished based on these findings.

The first aspect of the present invention is an abrasive tape for a magnetic information reading apparatus for photographic use comprising:

an abrasive layer including an abrasive and a binder and a support therefor having a thickness between 60 μm and 180 μm; and a hydrophilic colloid layer provided on the side of the support opposite to the side at which the abrasive layer is provided.

The second aspect of the invention is aAn abrasive tape package for magnetic information reading apparatus for photographic use comprising:

a cartrigde body, and a spool which is placed inside the cartrigde and rotatably supported by the cartrigde through a shaft, wherein the spool is wound by an abrasive tape for a magnetic information reading apparatus for photographic use comprising an abrasive layer including an abrasive and a binder and a support therefor having a thickness between 40 μm and 180 μm, the cartrigde has a feed passway for sending out the abrasive tape, and a pair of apparatus abrasive tape retainers are attached to the inside of the both ends of the shaft.

The third aspect of the invention is a method for cleaning a magnetic information reading apparatus for photographic use, comprising the step of cleaning the apparatus with the abrasive tape or the abrasive tape package.

In the above-described first aspect of the present invention, there is provided an abrasive tape for a magnetic information reading apparatus for photographic use comprising an abrasive layer including an abrasive and a binder and a support therefor having a thickness in a specified range.

Such a tape has not been disclosed for photographic use so far. It is considered that, by specifically limiting the thickness of the support, the total thickness of the abrasive tape can be approximated to that of a photosensitive material, thereby contributing to the attainment of the above-mentioned objects of the present invention.

In the second aspect of the present invention, there is provided a package which accommodates the abrasive tape in a specific cartridge. This embodiment is suitable for the application to cameras and similar apparatus. Therefore, it is preferable for achieving the objects of the present invention.

In the second aspect, it is preferred for improving handling properties thereof that a hydrophilic colloid layer is provided on the support so that the colloid layer and the abrasive layer be respectively formed on a different side of the support.

In the aspects, it is preferred for particularly improving an abrasive properties thereof to satisfy at least one of the requirements that the abrasive layer contains an abrasive having Mohs hardness of 5 or more, that the surface roughness according to Japanese Industrial Standard B 0601-1994 is from 0.01 to 0.6 μm, that the abrasive is selected from the group of consisting iron oxide, alumina, chromium oxide, silicon carbide and diamond.

In the third aspect of the present invention, there is provided a method for cleaning a magnetic information reading apparatus for photographic use which uses the above abrasive tape or the above abrasive tape package, thereby removing stains deposited onto the apparatus.

PREFERRED EMBODIMENTS OF THE INVENTION

Figure 1:
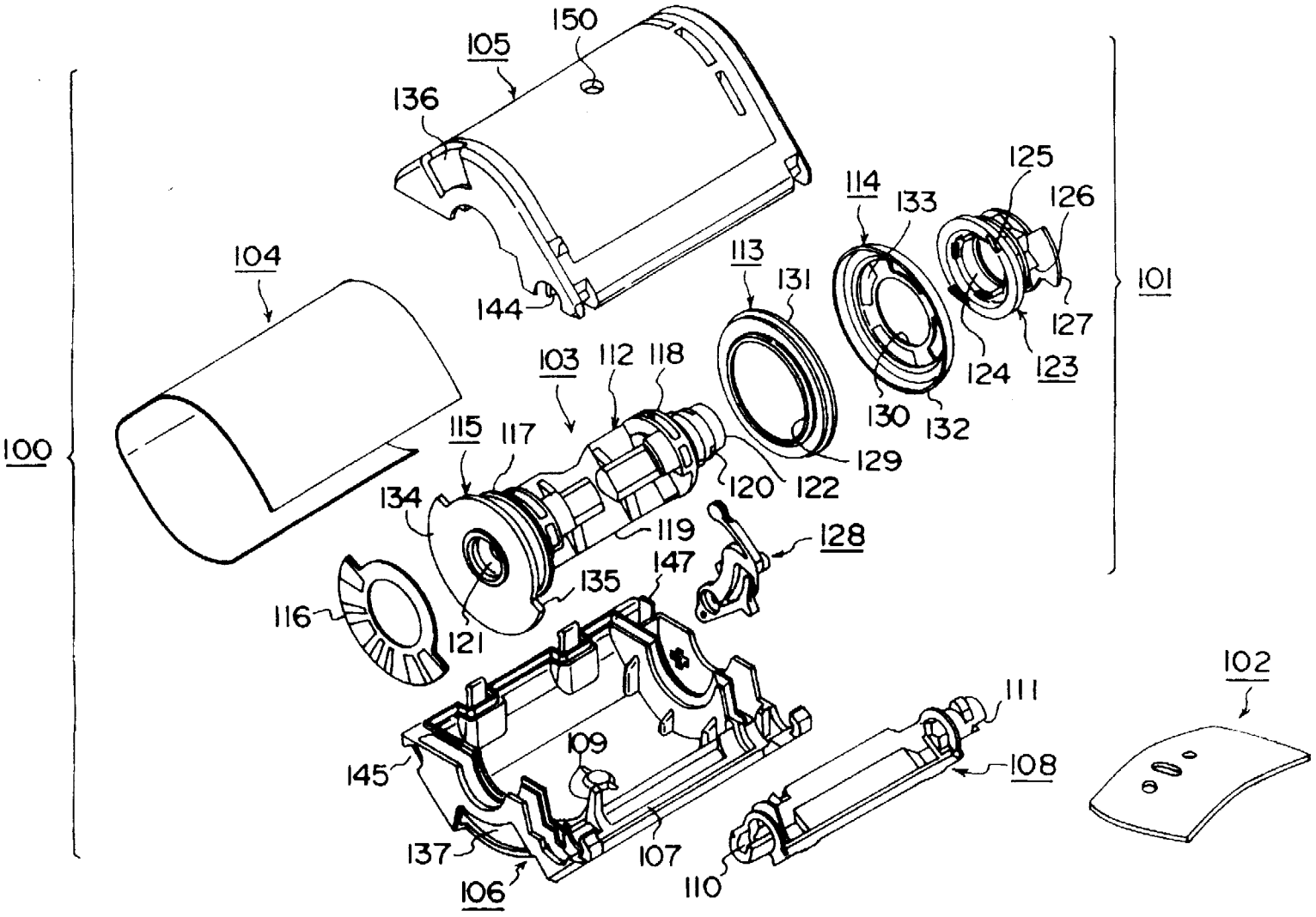
FIG. 1 is an exploded perspective view showing an abrasive tape package (abrasive tape cartridge) according to an embodiment of the present invention.

The present invention will next be described in detail.

First, a description will be given of the abrasive tape of the present invention, that is, the abrasive tape for a magnetic information reading apparatus for photographic use comprising; an abrasive layer including an abrasive and a binder; and a support therefor.

The abrasive tape generally has a surface roughness $R_a$ defined in JIS (Japanese Industrial Standards) B 0601-1994 in the range from 0.01 to 0.6 μm. It is particularly preferred that the roughness be in the range from 0.05 to 0.5 μm.

The abrasive contained in the abrasive layer of the present invention includes substances having a Mohs hardness of not less than 5, preferably 7, such as iron oxide, alumina, chromium oxides, silicon carbides, diamonds, and artificial diamonds. They are used singly or in combination. Its average particle size is generally in the range of 0.1 to 10 μm. More preferably, it is 0.1–5.0 μm, and particularly preferably 0.2–1.0 μm.

Binders which can be used in the abrasive layer in the present invention contain inorganic salts in amounts of not more than 0.1% by weight. They include vinyl chloride resins, urethane resins, polyisocyanate resins, as well as known thermoplastic resins, thermosetting resins, reactive resins, electron beam setting resins, UV setting resins, visible ray setting resins, mildewproofing resins, and mixtures of them.

The thermoplastic resins which are used in the present invention usually have a softening temperature of not higher than 150° C., molecular weight of 10,000–300,000, and a polymerization degree of about 50–2,000, preferably of 20 to 700. Specific examples of the thermoplastic resins include acrylic ester-acrylonitrile copolymers, acrylic ester-vinylidene chloride copolymers, acrylic ester-styrene copolymers, methacrylic ester-acrylonitrile copolymers, methacrylic ester-vinylidene chloride copolymers, methacrylic ester-styrene copolymers, urethane elastomers, nylon-silicone resins, nitrocellulose-polyamide resins, polyvinyl fluorides, vinylidene chloride-acrylonitrile copolymers, butadiene-acrylonitrile copolymers, polyamide resins, polyvinyl butyrals, cellulose derivatives (such as cellulose acetate butyrate, cellulose diacetate, cellulose triacetate, cellulose propionate, nitrocellulose, ethylcellulose, methylcellulose, propylcellulose, methylethylcellulose, carboxymethylcellulose, and acetylcellulose), styrene-butadiene copolymers, polyester resins, polycabonate resins, chlorovinylether-acrylic ester copolymers, amino resins, a variety of synthetic rubbers, and mixtures of them.

As examples of the vinyl chloride resins, mention may be given to vinyl chloride-vinyl acetate-vinyl alcohol copolymers, vinyl chloride-vinyl alcohol copolymers, vinyl chloride-vinylidene chloride copolymers, and vinyl chloride-acrylonitrile copolymers. Among them, vinyl chloride copolymers having $—(CHClCH_2)_n—(CHXCH_2)_m—$ (wherein X is a polar group such as $—SO_3Na$, $—SO_3H$, or $—PO_4H$) as a basic unit are preferred from the viewpoint of strength of the abrasive layer and dispersibility of abrasive particles. The most preferred vinyl chloride resins in view of dispersibility and strength of a coating film are MR110, 400X110A, and the like manufactured by Nippon Zeon Co., Ltd.

The thermosetting resins and reactive resins which can be used in the present invention may have a molecular weight of not more than 200,000 in the state of a coating liquid. However, when they are heated and humidified after coating and dry, they undergo condensation, addition, or like reactions and their molecular weight may become infinitely great. Among these resins, those which do not soften or melt before being thermally decomposed are preferred. Specific examples include phenol resins, phenoxy resins, epoxy resins, polyurethane resins, polyester resins, polyurethane carbonate resins, urea resins, melamine resins, alkyd resins, silicone resins, acrylic reactive resins (electron beam setting resins), epoxy-polyamide resins, nitrocellulose melamine resins, mixtures of a high molecular weight polyester resin and an isocyanate prepolymer, mixtures of a methacrylate copolymer and a diisocyanate prepolymer, mixtures of a polyester polyol and polyisocyanate, urea formaldehyde resins, low molecular weight glycol/high molecular weight diol/triphenylmethane triisocyanate mixtures, polyamine resins, polyimine resins, and their mixtures.

The type of the urethane resins is not particularly limited. It is possible to use any urethane resins which are used as binder resins in the art. For example, urethane resins having a 100% modulus of 50–300 kg/mm$^2$ and a glass transition temperature between −30° C. and 50° C. are preferred since they have capacity of retaining an abrasive in an abrasive layer and impart appropriate elasticity to the resulting coating film.

Specific examples of urethane resins include C-7209 and Pandex manufactured by Dainippon Ink and Chemicals, Inc., N-2301, N-2302, N-2304, and N-2307 manufactured by Nippon Polyurethane Industry Co., Ltd., and UR-8200, UR-8300, and UR-8600 manufactured by Toyobo Co., Ltd. Among them, one having in a molecular a polar group for accelerating dispersion of abrasive particles is particularly preferred. The above-mentioned thermoplastic, thermosetting, and reactive resins may contain, the following functional groups: Acidic groups such as carboxylate groups (COOM), sulfinate groups, sulfenate groups, sulfonate groups ($SO_3M$), phosphate groups (PO(OM)(OM)), phosphonate groups, sulfate groups ($OSO_3M$), and ester groups of them (M represents H, alkali metal, alkaline earth metal, or a hydrocarbon group); amphoteric groups such as amino acids, aminosulfonic acids sulfuric or phosphoric esters of alminoalcohols, sulfobetaine, phosphobetaine, alkylbetaine. The thermoplastic, thermosetting, and reactive resins may contain amino groups, imino groups, imide groups, amide groups, hydroxyl groups, alkoxyl groups, thiol groups, alkylthio groups, halogens (F, Cl, Br, I), silyl groups, siloxane groups, epoxy groups, isocyanato groups, cyano groups, nitrile groups, oxo groups, acrylic groups, and phosphine groups. Generally, one to six of these functional groups may be contained in the above resin. When each of the above functional groups is contained in an amount of $1\times10^{-6}$ eq to $1\times10^{-2}$ eq per g of the resin, dispersion of abrasive particles is promoted, and the strength of the resulting abrasive layer is improved.

The blending proportion of the abrasive(s) and binder resin(s) contained in an abrasive layer is generally 5 to 700, preferably 5–500, more preferably 7–200, parts by weight of binder resin(s) to 100 parts by weight of the abrasive(s).

The above-mentioned polyisocyanate resins are not particularly limited. They may be those conventionally used as binder resins. For example, there may be used isocyanates such as tolylene diisocyanate, 4,4"-diphenylmethane diisocyanate, hexamethylene diisocyanate, xylylene diisocyanate, naphthylene-1,5-diisocyanate, o-toluidine diisocyanate, isophorone diisocyanate, triphenylmethane triisocyanate, or isophorone diisocyanate. Also, the polyisocyanates include reaction products of the above-mentioned isocyanates and polyalcohols as well as polyisocyanate di-through decamers produced by condensation of isocyanates and polyurethanes and having a terminal isocyanate functional group. Particularly, 8 or more isocyanate groups (—NCO) in one molecule is preferable as it causes three-dimensional cross-linking.

The average molecular weight of these polyisocyanates is preferably from 100 to 20,000. Commercially available polyisocyanates include Coronate L, Coronate HL, Coronate 2030, Coronate 2031, Mirionate MR, Mirionate MTL (manufactured by Nippon Polyurethane Industry Co., Ltd.), Takenate D-102, Takenate D-110N, Takenate D-200, Takenate D-202, Takenate 300S, Takenate 500 (manufactured by Takeda Chemical Industries, Ltd.), Sumijule T-80, Sumijule 44S, Sumijule PF, Sumijule L, Sumijule N, Desmodule L, Desmodule IL, Desmodule N, Desmodule HL, Desmodule T65, Desmodule 15, Desmodule R, Desmodule RF, Desmodule SL, and Desmodule Z4273 (manufactured by Sumitomo Bayer Co.). They are used singly, or in combinations of two or more with differences in setting reactivity. Moreover, for the purpose of accelerating the setting reaction, a compound may be used together, including compounds having a hydroxyl group (for example, butanediol, hexanediol, and polyurethane having a molecular weight from 1,000 to 10,000, and water), compounds having an amino group (for example, monomethylamine, dimethylamine, and trimethylamine), and catalysts such as metal oxide catalysts and iron acetylacetates. The compounds having a hydroxyl group or an amino group are preferably polyfunctional.

Among the above-listed polyisocyanates, three-functional polyisocyanates are particularly preferred since they enhance three-dimensional cross-linking density. A specific example is Coronate 3040 manufactured by Nippon Polyurethane Industry Co., Ltd.

The abrasive layer may further contain additive compounds having different functions. Such additive compounds include dispersants, lubricants, antistatics, antioxidants, fungicides, colorants, and solvents.

These types of additives will next be described one by one.

Dispersants and dispersing aids may be added to a binder in order to help an abrasive to disperse in the binder. Examples of the dispersants or dispersing aids include $C_2$–$C_{40}$ fatty acids ($R_1COOH$, wherein $R_1$ is $C_1$–$C_{39}$ alkyl, phenyl, and aralkyl) such as caprylic acid, capric acid, lauric acid, myristic acid, palmitic acid, stearic acid, oleic acid, elaidic acid, linolic acid, linoleic acid, stearolic acid, behenic acid, maleic acid, and phthalic acid; alkali metal salts of these fatty acids (Li, Na, K, $NH_4^+$, etc.), alkaline earth metal salts of these fatty acids (Mg, Ca, Ba, etc.), metallic soap containing Cu and Pb (copper oleate, etc.); fatty amides; and lecithin (soybean oil lecithin). Other useful compounds include $C_4$–$C_{40}$ higher alcohols (butanol, octyl alcohol, myristyl alcohol, and stearyl alcohol) and the sulfuric acid esters thereof, sulfonic acid, phenylsulfonic acid, alkylsulfonic acid, sulfonic acid esters, phosphoric monoesters, phosphoric diesters, phosphoric triesters, alkyl phosphonic acid, phenyl phosphonic acid, and amine compounds. It is also possible to use polyethylene glycol, polyethylene oxide, sulfosuccinic acid, metal salts of sulfosuccinic acid, or sulfosuccinic acid esters. These dispersants are usually used singly or in combination. 0.005 to 20 parts by weight of one dispersant are used per 100 parts by weight of a binder. In use of the dispersants, they may be applied to surfaces of ferromagnetic fine particles or nonmagnetic fine particles in advance, or they may be added during dispersion.

The lubricants which can be used in the present invention may be in powder form. Examples include fine powders of inorganic materials such as graphite, molybdenum disulfide, boronitride, fluoro graphite, calcium carbonate, barium sulfate, silicon oxide, titanium oxide, zinc oxide, tin oxide, tungsten disulfide; fine powders of resins, such as styrene acrylate resins, fine powders of benzoguanamine resins, fine powders of melamin resins; fine powders of polyolefin resins; fine powders of polyester resins, fine powders of polyamide resins, fine powders of polyimide resins and fine powders of polyethylene fluoride resins. The abrasive layer may contain an organic lubricant to reduce the coefficient of friction and to control elasticity of the resulting coating film.

It is generally used in an amount of 0.01 to 10%, preferably 0.05 to 5%, by weight of the amount of abrasive particles.

The organic lubricant includes compounds to which fluorine or silicon has been introduced, such as silicone oils (dialkylpolysiloxanes, dialkoxypolysiloxanes, phenylpolysiloxanes, and fluoroalkyl polysiloxanes (KF 96, KF69, etc. manufactured by Shin-Etsu Chemical Co., Ltd.)); fatty acid-modified silicone oils, fluorine alcohols, polyolefins (for example, polyethylene wax and polypropylene), polyglycols (for example, ethylene glycol and polyethylene oxide wax), tetrafluoroethylene oxide wax, polytetrafluoroglycol, perfluoro alkyl ethers, perfluorofatty acid, perfluoro fatty acid esters, perfluoroalkylsulfates, perfluoroalkyl-sulfonates, perfluoroalkylbenzene sulfonates, and perfluoroalkylphosphates; organic acids and organic acid esters, such as alkyl sulfuric esters, alkyl sulfonic esters, alkyl phosphonic triesters, alkyl phosphonic monoesters, alkyl phosphonic diesters, alkyl phosphoric esters, and succinic esters; heterocyclic compounds containing N or S, such as triazaindolizine, tetraazaindolizine, benzotriazole, benzotriazine, benzodiazole, and EDTA; fatty acid esters such as those formed by a $C_{10}$–$C_{40}$ monobasic fatty acid and one or more $C_2$–$C_{40}$ monohydric, dihydric, trihydric, tetrahydric, or hexahydric alcohols; fatty acid esters composed of a monobasic fatty acid having 10 or more carbon atoms and a fatty acid of mono- through hexahydric alcohol whose carbon number plus the carbon number of the monobasic fatty acid falls in the range from 11 to 70; $C_8$–$C_{40}$ fatty acids or fatty acid amides; fatty acid alkylamides; and fatty alcohols.

Specific examples of these compounds include butyl caprylate, octyl caprylate, ethyl laurate, butyl laurate, octyl laurate, ethyl myristate, butyl myristate, octyl myristate, 2-ethylhexyl myristate, ethyl palmitate, butyl palmitate, octyl palmitate, 2-ethylhexyl palmitate, ethyl stearate, butyl stearate, isobutyl stearate, octyl stearate, 2-ethylhexyl stearate, amyl stearate, isoamyl stearate, 2-ethylpentyl stearate, 2-hexyldecyl stearate, isotridecyl stearate, amide stearate, alkylamide stearate, butoxyethyl stearate, anhydrosorbitan monostearate, anhydrosorbitan distearate, anhydrosorbitan tristearate, anhydrosorbitan tetrastearate, oleyl oleate, oleyl alcohol, lauryl alcohol, montan wax, and carnauba wax. They can be used singly or in combination.

The abrasive layer preferably contains carbon black, as the antistatics, in order to prevent electrostatic destruction caused by static electricity generated between the abrasive layer and ground materials. As carbon black, furness for rubbers, thermal for rubbers, black for color, and acetylene black may be used. They are used not only for the purpose of preventing charging of a tape, but also for shutting out light, adjusting the coefficient of friction and improving service life. Examples of the carbon blacks are, according to the U.S. system, SAF, ISAF, IISAF, T, HAF, SPF, FF, FEF, HMF, GPF, APF, SRF, MPF, ECF, SCF, CF, FT, MT, HCC, HCF, MCF, LFF, RCF, and so on, as abbrevation. Thus, carbon blacks classified under the U.S. standard, ASTM D-1765-82a may be used. Among the variety of carbon blacks, furnace black which satisfies the following conditions is preferred for effectively achieving the object of the invention.

The average particle size of these carbon blacks which can be used in the present invention is generally 5–100 nm (from electron microscopy). The carbon blacks have a specific surface ratio of 10–800 $m^2/g$ (by nitrogen adsorption method), a pH of 4–11 (by JIS K-6221, 1982), and an oil (DBP: dibutyl phthalate) absorption amount is 10–800 ml/100 g (by JIS K-6221, 1982). The average particle size of the carbon blacks used in the present invention is generally 5–100 nm, for controlling surface electrical resistance of the resulting coating film. In .order to control the strength of the coating film, it is generally 50–1,000 nm.

The specific type and amount of carbon blacks are suitably selected in accordance with the purpose of the abrasion tape. The carbon blacks may be used after they are surface-treated with dispersants which will be described below or after they are grafted to resins. Moreover, the carbon blacks may be such that they have undergone treatment in a furnace at a temperature of 2,000° C. or more during their manufacture in order to convert a part of their surfaces into graphite. Special carbon blacks, e.g., hollow carbon blacks, may also be used. When these carbon blacks are contained in the abrasive layer, they are preferably used in amounts of 0.1–100 parts by weight per 100 parts by weight of inorganic powders. When they are contained in a backing layer (a detailed description will be given below) which may be present in the abrasive tape of the present invention, they are preferably used in amounts of 20–400 parts by weight per 100 parts by weight of the resins described below. Information on carbon blacks which can be used in the present invention is available, for example, from "Handbook of Carbon Blacks" (compiled by Carbon Black Association, published in 1971). It is preferred that the Na content in any powders that may be used in the present invention be not more than 0.1% by weight (excepting alumina powders). Antistatics other than carbon blacks include electric conductive powders such as graphite, denatured graphite, carbon black graft polymers, tin oxide—antimony oxide combinations, tin oxides, titanium oxide—tin oxide—antimony oxide combinations; natural surfactants such as saponin; nonionic surfactants such as alkylene oxides, glycerol, glycidol, polyols, polyol esters, alkylphenol EO adducts; cationic surfactants such as higher alkylamines, cyclic amines, hydantoin derivatives, amide amines, ester amides, quaternary ammonium salts, pyridine and other heterocyclic compounds, phosphonium compounds and sulfonium compounds; anionic surfactants containing acidic groups such as carboxylic acid, sulfonic acid, phophonic acid, phosphoric acid, sulfuric esters, phosphonic or phosphoric esters; amino acids; amphoteric surfactants such as aminosulfonic acids, sulfuric or phosphoric esters of amino alcohols, and alkylbetaine-type surfactants.

Some of the surfactants which can be used as antistatics are described in "Synthesis and Application of Surfactants" (Maki Publishing Co., 1972); A. W. Beilley "Surface Active Agents" (Inter Science Publication Corporate, 1985); T. P. Cisley "Encyclopedia of Surface Active Agents, Vol. 2" (Chemical Publish Company, 1964); "Handbook of Surfactants" 6th ed. (Sangyo Tosho Corp., Dec. 20, 1966); and Hideo MARUMO "Antistatics" (Sachi shobo, 1968).

These surfactants may be used singly or in combination. Although they are primarily used as antistatics, they may also be used for other purposes such as for improving dispersion and lubricity, as coating aids, humecting agents, setting accelerators, and dispersion accelerators.

Examples of antioxidants include those which are also commonly known as antirusting agents, for example, alkylphenols, benzotriazines, tetraazaindenes, sufamides, guanidines, nucleic acids, pyridines, amines, hydroquinones, and metal chelating agents such as EDTA; naphthenic acid, alkenylsuccinic acids, phosphoric acid, dilauryl phosphates, which are also know as an antirusting agent; rape seed oil, lauryl alcohols, which are know as an oil agent, and extreme pressure agents such as dibenzylsulfide, tricresylphosphate, and tributylphosphite.

They are also used as cleansing and dispersing agents, viscosity index improvers, pour point decreasing agents, and antifoaming agents. These lubricants are usually added in amounts between 0.01 to 30 parts by weight per 100 parts by weight of a binder.

Examples of the fungicides include 2-(4-thiazolyl) benzimidazole, N-(fluorodichloromethylthio)phthalimide, 10,10'-oxybisphenoxarsine, 2,4,5,6-tetrachloroisophthalonitrile, p-tolyldiiodomethylsulfone, triiodoallylalcohol, dihydroacetic acid, mercury phenyloleate, bis(tributyl)tin oxide, and salicylanilide.

They are disclosed, for example, in "Microorganism Hazards and Prevention Techniques" (1972, Kogaku Tosho Publishing Co.), and "Chemistry and Industry" 32, 904 (1974).

Examples of colorants include dyes such as phthalocyanine dyes, cyanine dyes, and chelating dyes, and industrial colorants used for preparing pigments.

Solvents are used during dispersing, kneading, and coating operations. Examples of solvents include ketones such as acetone, methylethylketone, methylisobutylketone, cyclohexanone and isophorone; alcohols such as methanol, ethanol, propanol, butanol, isobutyl alcohol, isopropyl alcohol, and methylcyclohexanol; esters such as methyl acetate, ethyl acetate, butyl acetate, isobutyl acetate, isopropyl acetate, ethyl lactate, and glycol acetate monoethylether; ethers such as tetrahydrofuran, diethyl ether, glycol dimethylether, glycol monoethylether, and dioxane; tars (aromatic hydrocarbons) such as benzene, toluene, xylene, cresol, chlorobenzene, and styrene; chlorinated hydrocarbons such as methylene chloride, ethylene chloride, carbon tetrachloride, chloroform, ethylenechlorohydrin, and dichlorobenzene; N,N-dimethylformaldehyde, hexane, and water. They are usually used in a combination of two or more species and at any proportion. They may contain a trace amount (not higher than 1% by weight) of impurities, for example, polymerized products of the solvents themselves, water, and starting materials. These solvents are generally used in amounts of 100–20,000 parts by weight per 100 parts by weight of the solid content in the total coating liquid. Preferably, the solid content in the coating liquid is 1–70% by weight.

Next, the method for forming an abrasive layer will be described. The above-mentioned compounds in an arbitrary combination are dissolved in an organic solvent. The resulting solution is kneaded and dispersed in order to prepare a coating solution. The coating solution is applied onto a support, followed by drying, cutting and cleaning. As a result, an abrasive layer is obtained.

No limitations are imposed on the dissolving, dispersing, and kneading methods. The order of adding components (such as resins, powders, lubricants, and solvents); stages during dissolving, dispersing, or kneading; and dispersing temperature (0°–80° C.) can be determined as needed. To prepare abrasive paints (coating liquids), general stirrers, dispersers, and kneaders can be used which include two roll mills, three roll mills, ball mills, pebble mills, tron mills, sand grinders, Szegvari attriters, high speed impellers, high speed stone mills, high speed impact mills, dispers, kneaders, high speed mixers, ribbon blenders, co-kneaders, intensive mixers, tumblers, blenders, dispersers, homogenizers, uniaxial screw extruders, biaxial screw extruders, and ultrasonic dispersers. In usual cases, a plurality of these devices are used, and dissolving, dispersing, and kneading operations are performed in a continuous manner. For more information on techniques of kneading and dispersing, see T. C. Patton, "Paint Flow and Pigment Dispersion" (1964, published by John Wiley & Sons), Shinichi TANAKA, "Industrial materials" Vol. 25, 37 (1977), and references cited therein. In order for the components to be dispersed and kneaded effectively, steel balls, steel beads, ceramic beads, glass beads, and organic polymer beads having a sphere equivalent diameter of 10 cm to 0.05 mm may be used as auxiliary materials. The auxiliary materials are not necessarily spherical. U.S. Pat. No. 2,581,414 and U.S. Pat. No. 2,855,156 provide information on the technique. In the present invention, the components are kneaded and dispersed in accordance with any one of the methods described in the above-mentioned literature and references cited therein to prepare abrasive layer paints and backing layer paints.

In applying a coating liquid which forms an abrasive layer onto a support, a painting or spraying method may be used. If painting is performed, the viscosity of the liquid is adjusted to 1–20,000 cSt (25° C.). Helpful apparatuses include air doctor coaters, blade coaters, air knife coaters, squeeze coaters, impregnation coaters, reverse roll coaters, transfer roll coaters, gravure coaters, kiss-roll coaters, cast coaters, spray coaters, rod coaters, forward rotation roll coaters, curtain coaters, extrusion coaters, bar coaters, and lip coaters. Other apparatuses and methods may also be used. Detailed descriptions of these devices are provided in "Coating Engineering" (pp. 253–277, published by Asakura Shoten on Mar. 20, 1971). Before coating with a desired liquid, corona discharge treatment may be performed so as to achieve a tighter and stronger contact with an undercoat or support. When abrasive multiple layers are formed, simultaneous multiple coating, sequential multiple coating, or similar coating methods may be used. These are described in, for example, JP-A-57-123,532, JP-B-62-37,451, JP-A-59-142,741, and JP-A-59-165,239.

By any one of the above methods, a panting liquid is applied onto a support in a thickness of about 1 to 1000 um. Immediately thereafter, the painted support is dried at 20°–130° C. The formed abrasive layer is dried, in general cases, to a thickness of 1–100 um. The thickness of the abrasive layer after being dried is preferably from 0.5 to 25 um, and particularly preferably, from 0.8 to 15 um. During the painting operation, the support is usually conveyed at a speed between 10 m/min and 900 m/min. The support passes through a plurality of drying zones while the drying temperature is controlled between 20° and 130° C. so that the amount of residual solvents remaining in the paint film is between 0.1 and 40 mg/m$^2$. If desired, other layers may also be formed by a similar procedure. Subsequently, surface smoothing treatment or similar treatment is performed. The resulting multi-layered sheet is cut to a desired shape and size, thereby obtaining the abrasive tape of the present invention. In performing the above described methods, it is preferred that the following steps be sequentially carried out: pretreatment and surface treatment of powders, kneading and dispersing steps, painting, orientating and drying steps, a smoothing step, a heat-treatment step, an EB treatment step, a surface cleaning step, a cutting step, and a take-up step.

After the thus-made abrasive tape is cut to a proper size, it is taken up by a desired plastic or metallic reel. It is preferred that immediately before taking up or during prior steps, the abrasive tape (its abrasive layer, backing layer, edge surface, and base surface) be varnished and/or cleaned. In varnishing, the protrusions in the surface of the abrasive tape are chipped to make an even or smooth surface by using hard materials that are suitable for controlling the surface roughness and abrasive power of the abrasive tape, e.g., sapphire blades, razor blades, blades made of cemented carbides, diamond blades, and ceramic blades. These hard materials preferably have a Mohs hardness of not less than 8, which is not particularly limited as long as it makes removal of protrusions possible. Also, these materials do not necessarily have a blade shape. They can have a square, round, or a wheel shape. Alternatively, these materials may be attached onto the periphery of a rotatable cylinder. The abrasive tape is subjected to a cleaning step for the purpose of removing smudges and excessive lubricants from the tape surfaces. Cleaning is performed by wiping the abrasive layer surface, edge faces, and the base surface of the backing layer with a nonwoven fabric or similar materials. Examples of materials for performing wiping include a variety of Vilenes manufactured by Japan Vilene Co., Ltd., Torecy and Excene manufactured by Toray Industries, Inc., and Kimwipe (trademark). Nonwoven fabrics which may be used are those of nylons, polyesters, rayons, acrylontriles, and blended yarns, as well as tissue paper.

The abrasive tape of the present invention has an abrasive layer on a support. The tape may further have a backing layer, an intermediate layer, and an undercoat layer which serves as a separation-preventing layer for the prevention of separation of layers.

Example of materials of the support include, which are not limited to, polyesters such as polyethylene terephthalate and polyethylene naphthalate, polyolefins such as polypropylene, cellulose derivatives such as cellulose triacetate and cellulose diacetate, vinyl resins such as polyvinyl chloride, plastics such as polycarbonates, polyimides, polyamides, polysulfones, polyphenylsulfones, and polybenzoxazoles. Also, it is possible to use metals such as aluminum and copper, and ceramics such as glass. The support made of such a material may undergo corona discharge treatment, plasma treatment, undercoating treatment, thermal treatment, dust-removing treatment, metal vapor deposition treatment, and alkali treatment before it is coated with a coating liquid. Information on treatments of supports is described in DE-P-3338854A, JP-A-59-116926, JP-A-61-129,731, U.S. Pat. No. 4,388,368, and Yukio MITSUISHI "Fibers and Industry" Vol. 31, pp. 50–55, 1975. As long as abrasive tapes are concerned, the average surface roughness on the center line of these supports is preferably from 0.001 to 1.5 μm (curoff value: 0.25 mm).

In the present invention, the support has a thickness between 40 and 180 μm. Preferably, the thickness of the support is 60–150 μm.

If it is less than 40 μm, the relative thickness of the abrasive tape for reading magnetic information for an apparatus for photographic use with respect to the total thickness of a photosensitive material is small. As a result, it becomes difficult to achieve the objects of the present invention, i.e., to remove stains from the apparatus and reduce errors in reading magnetic information. On the other hand, if the thickness is greater than 180 μm, the relative thickness of the abrasive tape for a reading magnetic information for photographic use with respect to the total thickness of the photosensitive material is great. Consequently, the apparatus for photographic use (such as a magnetic head) is greatly ground, thereby bringing about drawbacks in economy including a reduced service life of the apparatus and increase in costs for supports.

In the present invention, the thickness of the support is from 40 to 180 μm. The total thickness of the abrasive tape is preferably from 40.5 to 210 μm, more preferably from 60.5 to 180 μm, and particularly preferably from 70.5 to 150 μm.

Moreover, in this invention, the length of the abrasive tape in the width direction perpendicular to its longitudinal length is generally from 16 to 35 mm. In order to serve as an abrasive tape for a magnetic information reading apparatus for photographic use, the width is preferably 35 mm or 24 mm, with 24 mm being particularly preferred.

Also, it is preferred that the Young's modulus in either longitudinal or width direction be 400 or more $kg/mm^2$ in view of the prolonged service life of the tape.

Generally speaking, it is preferred that a backing layer, intermediate layer, and an undercoat layer be provided in order to control friction, elasticity, and contact strength. A backing layer is provided on the back side of an abrasive layer with a support therebetween. An intermediate layer is a layer that does not contain abrasives and is provided between a support and an abrasive layer. An undercoat layer is provided for enhancing the contact strength of two layers. Each layer may be made of the same material(s) as the abrasive layer which are described hereinbefore. Also, the abrasive tape may have a multi-layered structure using different sizes of abrasives and two or more different types of layers with different thicknesses.

As to the method for the manufacture of the abrasive tape, according to the invention, JP-B-56-26890 may further be referred to in which magnetic recording media are disclosed.

Figure 2:
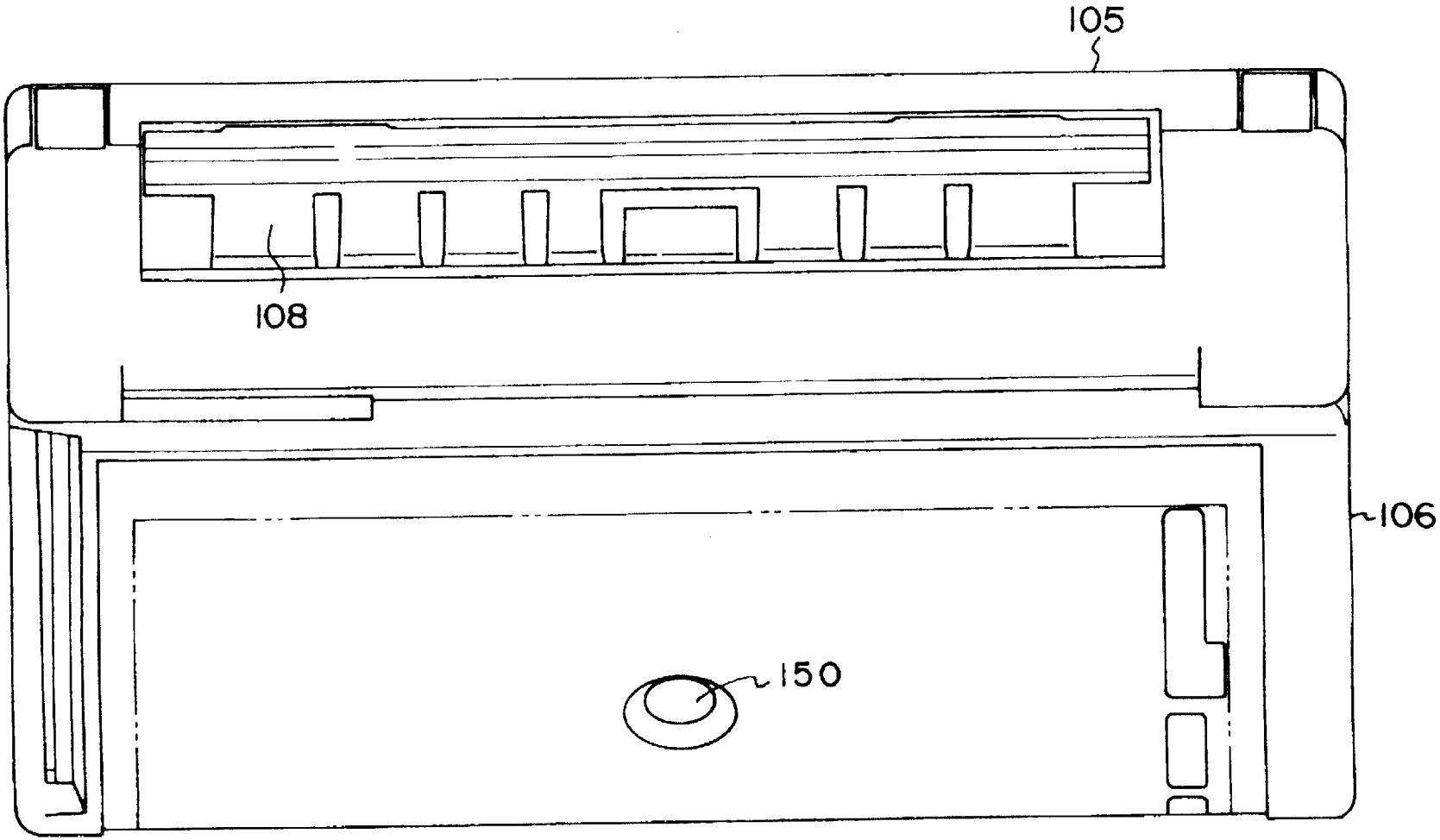
FIG. 2 is a view showing the above abrasive tape package as viewed from a radial direction.
Figure 3:
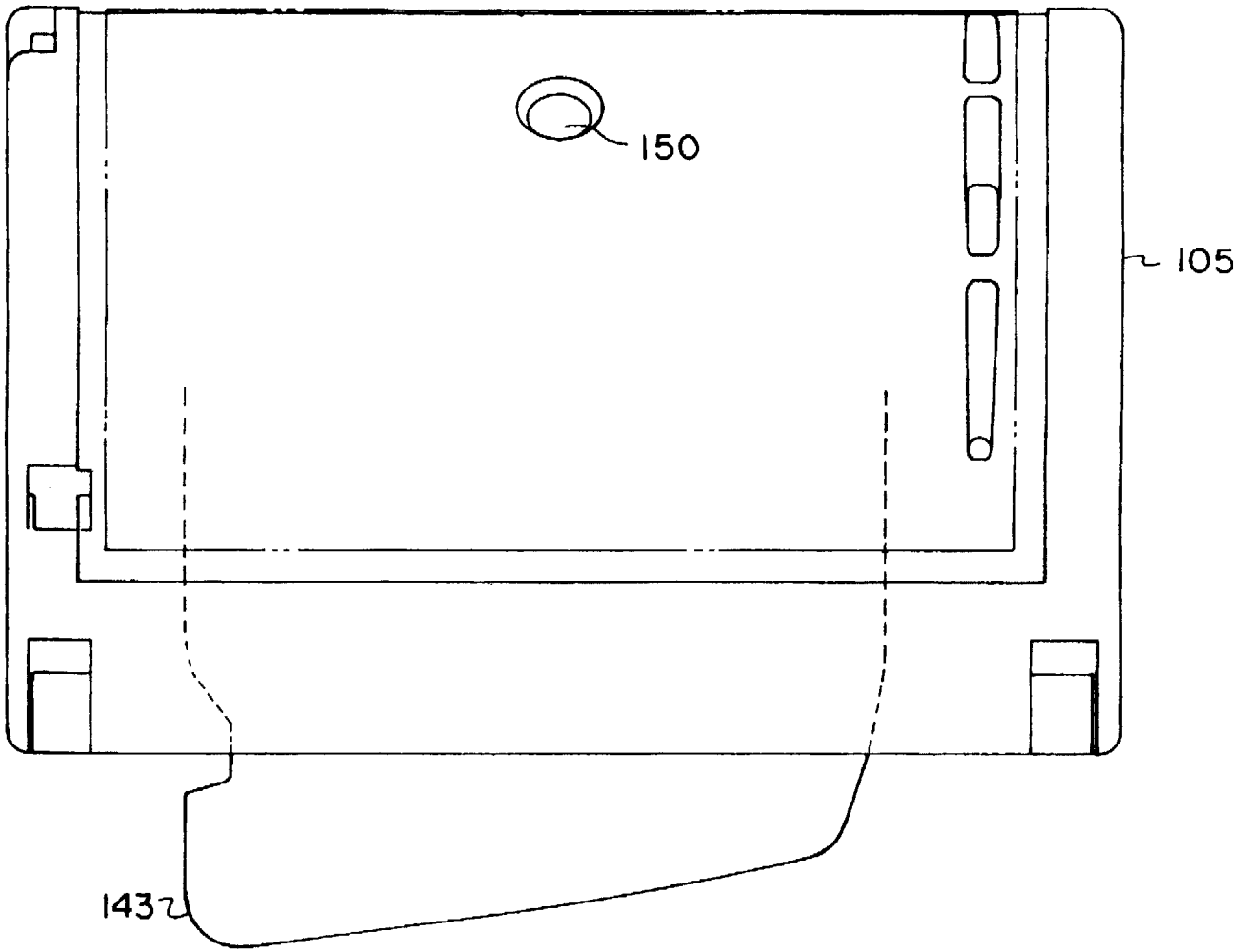
FIG. 3 is a view showing the above abrasive tape package as viewed from a different radial direction.

Next, the structure of an abrasive package for magnetic information reading apparatus for photographic use (hereinafter referred to as an abrasive tape cartridge) 100 according to an embodiment of the present invention will be described with reference to the accompanying drawings. FIG. 1 is an exploded perspective view showing the abrasive tape cartridge. FIG. 2 is a view showing the cartridge as viewed from a radial direction, and FIG. 3 is a view showing the cartridge as viewed from a different radial direction.

The abrasive tape cartridge 100 comprises a cartridge body 101 and a spool 103 around which an abrasive tape 102 is wound. The spool 103 is rotatably accommodated in the cartridge body 101. A cartridge label 104 is adhered to the outer periphery of the cartridge body. The cartridge body 101 is made of two molded parts which are upper and lower cases 105 and 106.

Figure 5:
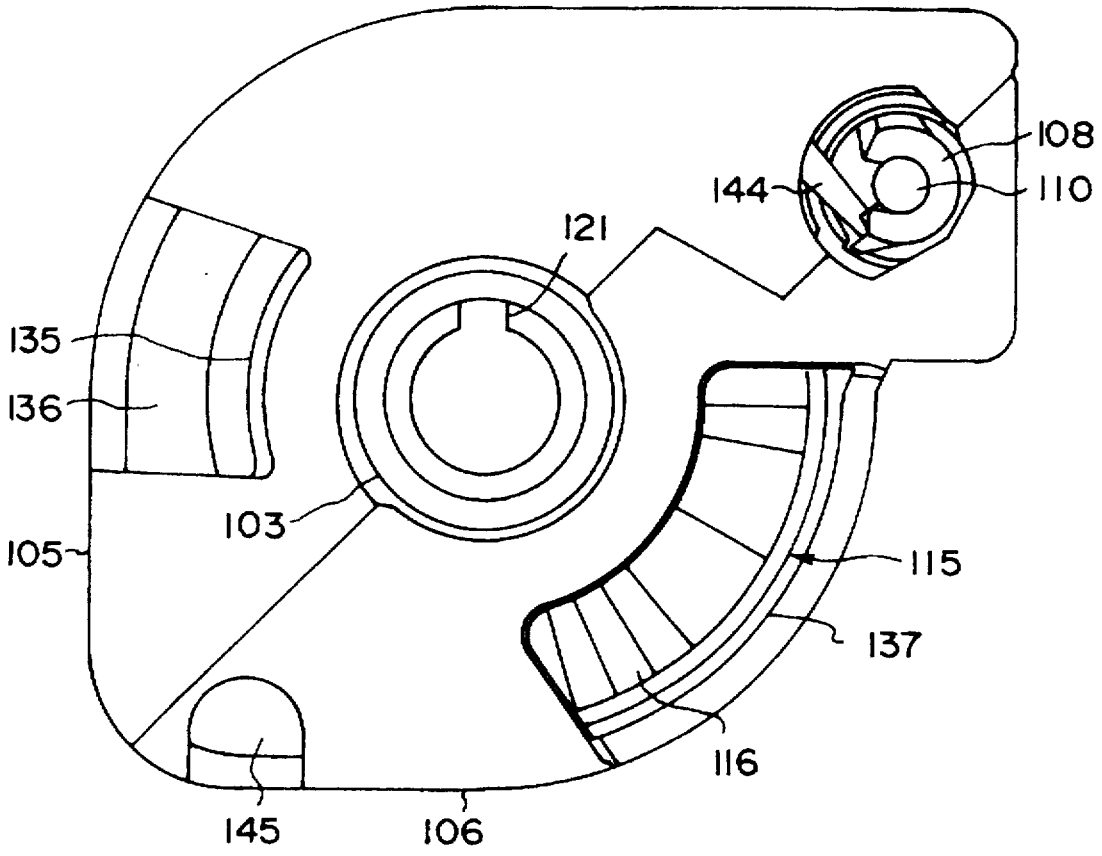
FIG. 5 is a view showing the above abrasive tape package as viewed from an opposite axial direction.

At the front side of the joining portions of the upper-case 105 having a gate 150 and lower case 106, a tape feed port 107 (passway) for sending out an abrasive tape 102 is positioned. At the back side of the tape feed potion 107 are provided a lid member 108, and a release claw 109, at the inner part of the lid member, for releasing the front end of the abrasive tape 102 is positioned. The lid member 108 has key grooves 110 and 11 at its two ends. When the cartridge is placed in a camera, the lid member is rotated between a closing position (at which the tape feed port 107 is closed) and an opening position (at which the abrasive tape 102 is permitted to go in and out) in response to the rotation of opening/closing driving shafts of the camera which engage with the key grooves 110 and 111. FIG. 5 shows the state in which lock pole 144 and a lid member 108 are engaged so as to lock the lid member at the closing position.

A pair of flanges 113, 114 each having a lip are attached to the inside of both ends of the spool shaft 112. A data disk is provided outside the flange 113. A use indicator member 123 is provided outside the flange 114. A data label is attached to the data disk 115. The spool shaft 112, the data disk 115, a pair of flange engagement portions 117, 118 for engagement with flanges 113, 114, a slit 119 for holding the tailing end of the abrasive tape, and a support for the use indicator member 120 are integrally formed. When the cartridge is placed in a camera, driving shafts of the camera are engaged with key grooves 121, 122 on key holes provided at both ends of the spool 103. The spool is rotated in response to the rotation of the driving shafts.

The use indicator member 123 is integrally formed of a bearing 124, two ratchet claws 125, a gear 126, and a use indicating plate 127. They are rotated together with the spool shaft 112.

Inside the abrasive tape cartridge 100, a spool lock 128 is disposed such that it is meshed with a gear 126. When the lid member is at a closing position, the spool lock 128 is engaged with the gear 126 to lock the rotation of the spool shaft 112 to prevent unnecessary feeding of the abrasive tape 102. On the other hand, when the lid member 109 is at the opening position, spool lock is released from the engagement with the gear 126.

Figure 6:
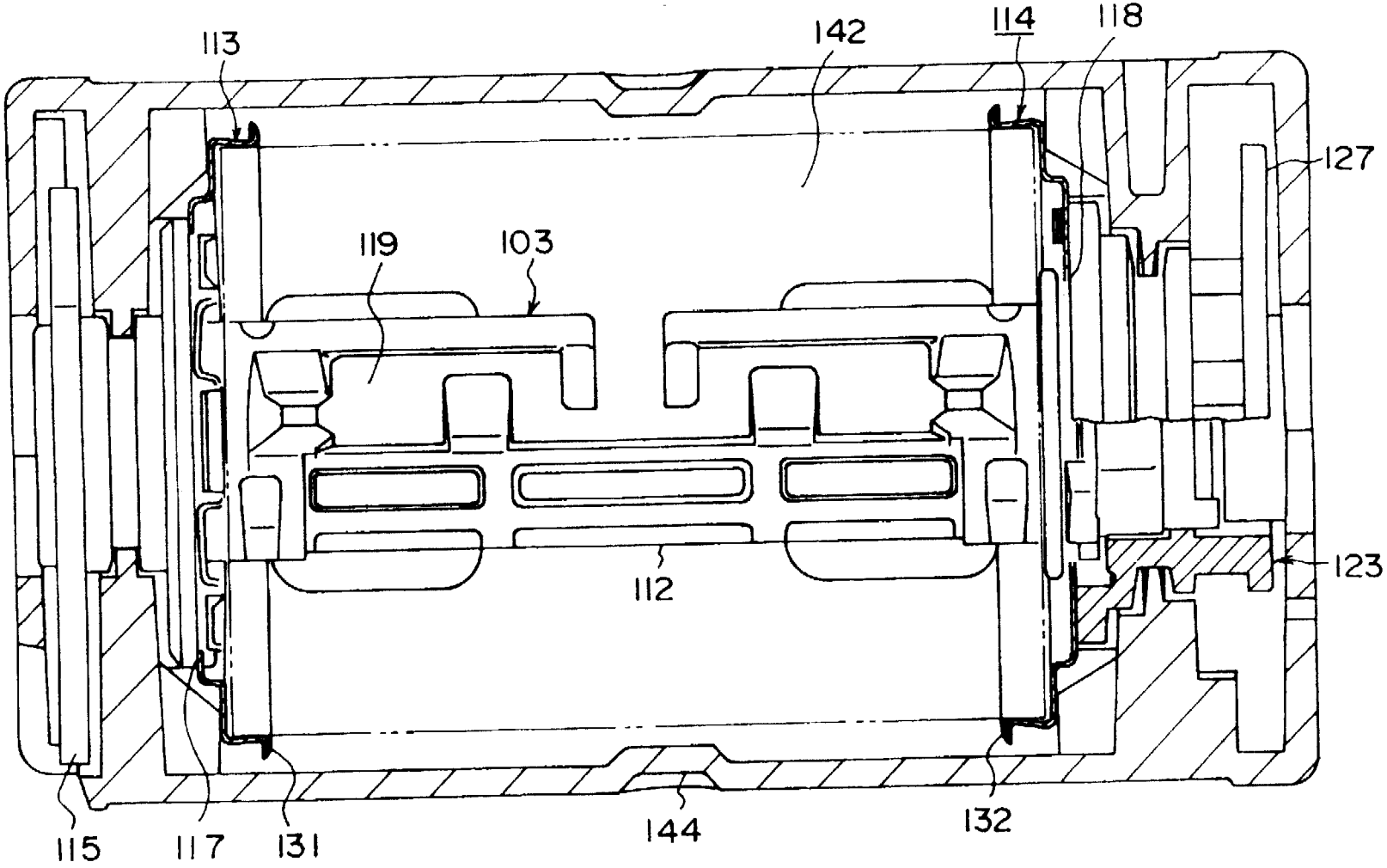
FIG. 6 is a sectional view showing the above abrasive tape package cut along an axial direction.

The pair of flanges 113, 114 are made of a plastic material. They have a cross section of a thin cup shape. At the bottom of the cup shape, round holes 129, 130 are provided for rotatable engagement with the flange engagement portions 117, 118, respectively. The peripheries 131 and 132 of the openings of the cup shape face one to another when the flanges are attached to the spool shaft 112, thereby enclosing the outermost edges of the wounded abrasive tape 102 wound between the peripheries 131, 132 (see FIG. 6). Owing to these opening peripheries 131, 132, the rotation of the spool 103 can be transmitted to the outer peripheries of the abrasive tape 102, and loosening of a wound tape roll 142 is prevented.

Four holes 133 are formed in the flange 114 at a predetermined pitch so as to encircle the round hole 130. These holes 133 are engaged with a ratchet claw 125 of the use indicator member 123 when the spool shaft 112 is rotated in the feeding direction of the abrasive tape. The ratchet claw 125 transmits the rotation of the spool shaft 112 to the flange 114 when it is engaged with the hole 133. When the spool shaft 112 is rotated in the winding direction of the abrasive tape, the ratchet claw 125 of the use indicator member 123 is not engaged with the hole. Therefore, it does not transmit the rotation of the spool shaft 112 to the flange 114.

In order to feed the abrasive tape 102, the spool 103 is rotated in the feeding direction of the tape. As the spool 103 is rotated in this direction, the tip end of the abrasive tape 102 comes into contact with the release claw 109 to release the tip of the tape from the wound position. Subsequently, when the spool 103 is rotated, the pair of thin flanges 113 and 114 which has elasticity are urged in the outer direction by the tip of the released tape. As a result, the tip end of the abrasive tape (indicated by 143 in FIG. 3), released from the enclosed state by the pair of flanges 113 and 114, is sent out of the abrasive tape cartridge 100 through the tape feed port. When the spool shaft 112 is rotated in the take-up direction of the abrasive tape (in the reverse direction of the tape feeding direction), neither flange 113 nor 114 rotates together with the spool shaft 112. Therefore, when the abrasive tape is advanced, flanges 113, 114 do not rotate, thereby generating slipping between the opening peripheries 131, 132 and the abrasive tape 102. Thus, the tape 102 slips in the peripheries 131,132 of the flange openings to be wounded.

The data disk 115 comprises a large-diameter fan-shaped portion 134 and a notch portion 135. A bar code label 116 has a shape similar to the data disk 115 and is attached to the data disk.

A bar code is printed on the bar code label 116, and represents various pieces of information such as the kind of the abrasive tape which is accommodated. When the spool 103 is rotated in the tape feeding direction, the information is read by a reading sensor which is provided on the camera side through an opening 136 formed in a side wall of the upper case 105 and shown in FIG. 5. The information is useful for checking the kind of the abrasive tape 102 which is accommodated and counting the length of the tape in the feeding direction.

The abrasive tape cartridge 100 accommodates even the leading edge of the entire abrasive tape. Therefore, whether or not an abrasive tape is contained cannot be known from the outside. Thus, to recharge the abrasive tape cartridge 100 which accommodates the abrasive tape 102 in the camera before performing abrasion, an opening 137 is formed in one side wall of the lower case 106. The side wall corresponds to the side that faces a cartridge room for being inserted therein. In the cartridge room is provided a lever which protrudes into the opening 137.

In order to make it possible to reuse the abrasive tape 102 after the tape 102 is used for abrasion and is accommodated into the cartridge 100 after the abrasion, information is in advance supplied to the cartridge 100, the information being for becoming the state where the large-diameter fan-shaped portion 134 does not appear in the opening 137. Thus, the abrasive tape cartridge 100 is controlled so that the stopping position of the spool 103 returns to its original position by the driving shafts of the camera. Therefore, by detecting the absence of a motion of the lever of the camera side, a user can use the abrasive tape 102 again.

Figure 4:
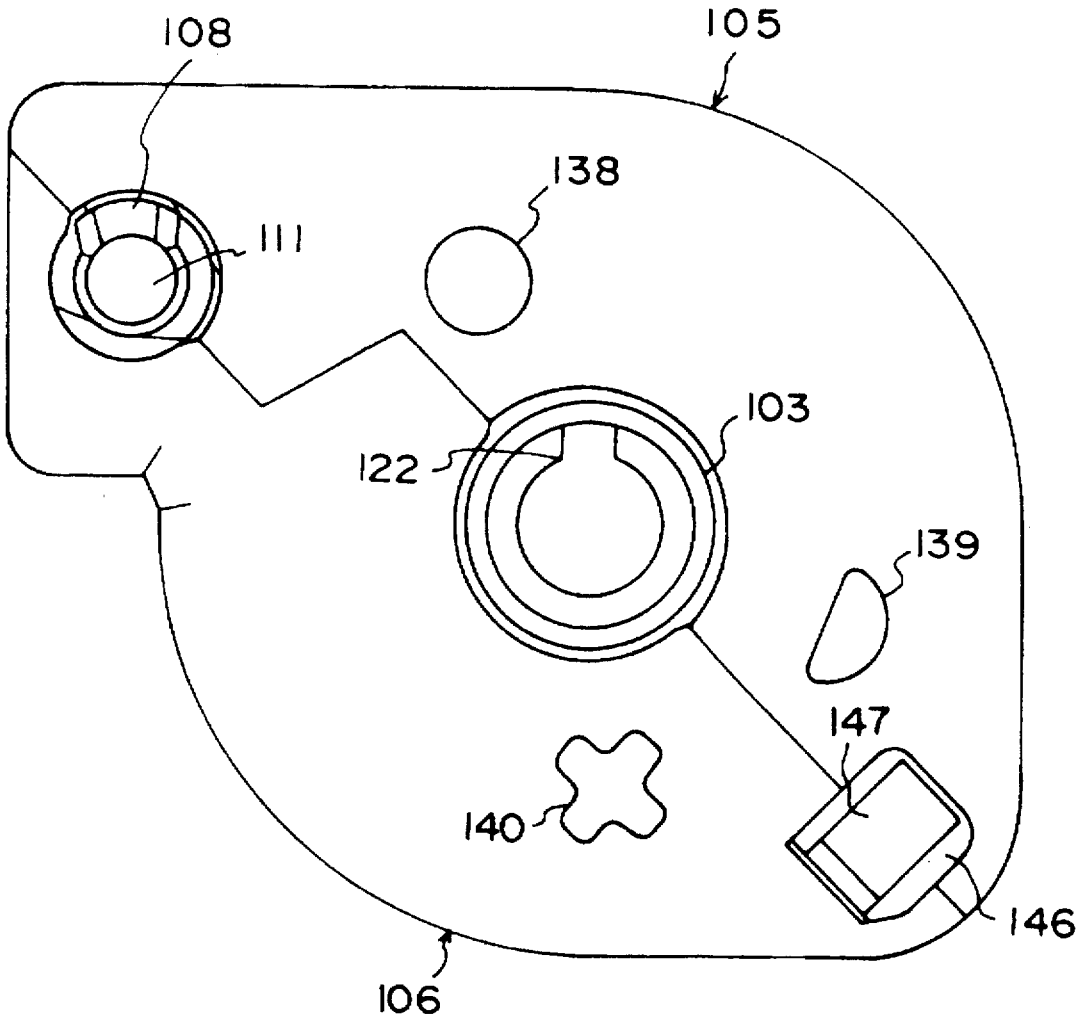
FIG. 4 is a view showing the above abrasive tape package as viewed from an axial direction.

Moreover, as shown in FIG. 4, in order to allow users to confirm the status of use of the tape from the outside, in another side wall (the wall opposite to that provided with openings 136,137) of the abrasive tape cartridge 100, are provided a window 138 for showing the current status of use that the abrasive tape 102 is accommodated, a window 139 for showing the status of use that a partly used abrasive tape 102 is accommodated, and a window 140 for showing the status of use that an entirely used abrasive tape 102 is accommodated. The status of use of the abrasive tape 102 is shown by controlling the stop position of the spool 103 to expose a use indicator plate 127 to any one of the windows 138 to 140.

The cartridge 100 has a specific detecting notch 145 for detecting the abrasive tape 102 which has been accommodated therein. The notch is for being detected by a low-price camera with no bar code readers that can read bar codes on a boar code label. In the case where a specific detecting notch 145 is provided as shown in FIG. 5, the contained article is not a photosensitive material but an abrasive tape.

The cartridge 100 includes an indication tab which shows whether or not the accommodated abrasive tape 102 is usable. As shown in FIG. 4, this tab 147 is provided in the opening 146 in one side wall of the cartridge 100. If the tab 147 has been snapped, it indicates that the abrasive tape 102 should not be used due to, for example, deteriorated properties and an expired validity term.

A typical example for making a cartridge is described below. The upper and lower cases 105 and 106, spool 103, and the lid member 108 are injection-molded using a resin obtained by kneading a high impact polystyrene resin (Denkastyrol H1-R-Q manufactured by Denki Kagaku Kogyo K.K.), 1.0% by weight of a carbon black (for imparting light shielding properties) (Mitsubishi Carbon Black #950 manufactured by Mitsubishi Kagaku Corp.), and 1.54 by weight of a silicone oil (for imparting lubricity) (Shin-Etsu Silicone KF96H—viscosity: 30,000 cs manufactured by Shin-Etsu Chemical Co., Ltd.).

The use indicator member 123 is formed by injection molding using a resin obtained by kneading the above-mentioned high impact polystyrene resin, 0.01% by weight of the above-mentioned carbon black, and 3.5% by weight of a titanium oxide (CR60-2 manufactured by Ishihara Sangyo Kaisha, Ltd..

Flanges 113, 114 are formed by a vacuum/pressurized air method using a film prepared from a polymer alloy (Ziron X9101 manufactured by Asahi Chemical Industry, Co., Ltd.) of a polystyrene resin and a polyphenylene ether resin having a thickness of 150 um.

Figure 7:
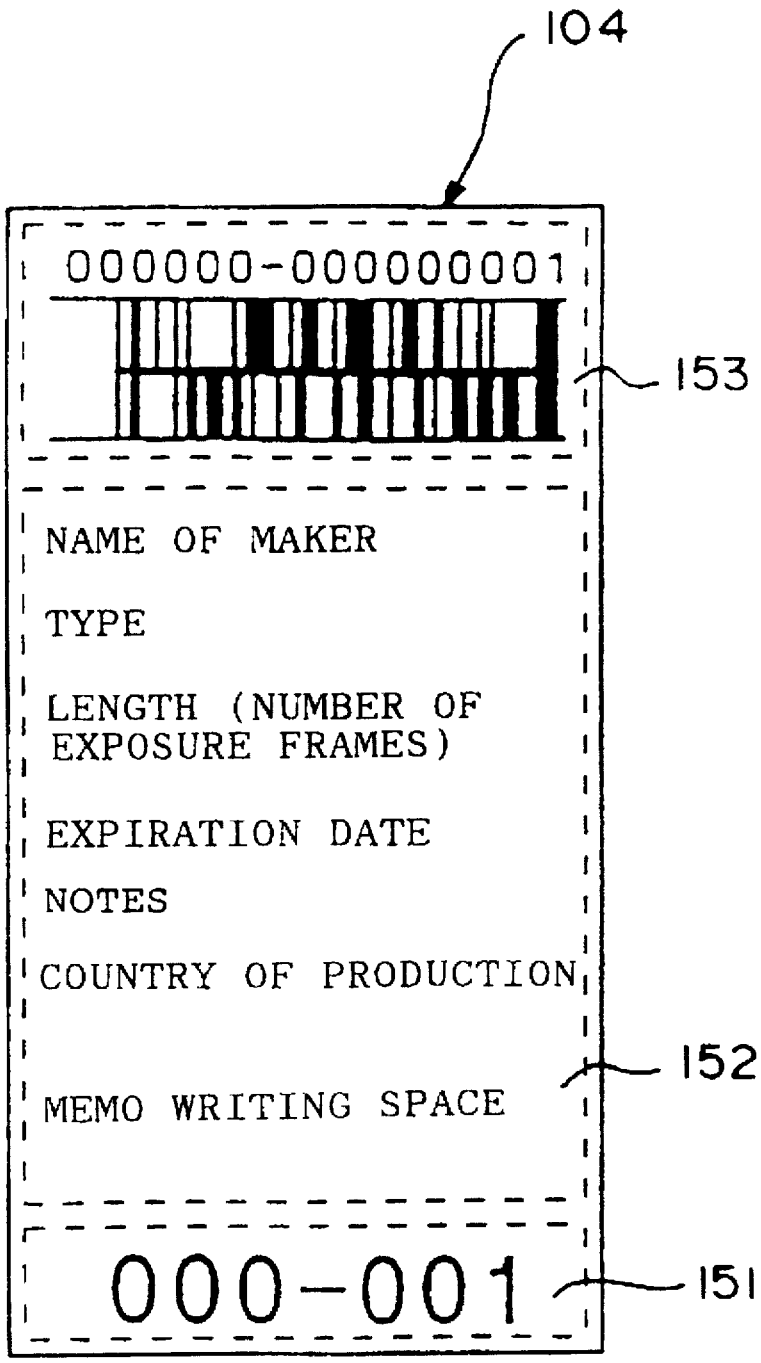
FIG. 7 is a sticking label material having a backing release paper.

The cartrigde label 104 is prepared by first performing coating for imparting a printing suitabilit on one side of a polystyrene film (thickness: 50 um) containing a white pigment. To its back surface, an adhesive agent is applied, and then release paper is attached, thereby obtaining an adhesive label material with the release paper. As shown in FIG. 7, there are provided, on the surface of it, a space 151 for printing cartrigde ID numerals, a characteristic-printing space 152 for printing the name of manufacturer, trademark, type of the tape/length of the tape (corresponding to the number of exposure frames), notes, and the memo space in which a user will write, and a space 153 for printing a bar code. The characteristics are first printed on the space 152. Then, a half cutting processing is performed. Thereafter, a bar code and a cartrigde ID number are printed. The bar code contains coded information on the name of manufacturer, lot number, date of manufacture, kind of the abrasive tape contained, length of the tape (corresponding to the number of exposed frames), and a cartrigde ID number. The cartrigde ID number is a characteristic number given to each cartrigde.

The bar code label 116 is made by forming an aluminum deposit layer having a thickness of about 400 angstroms on one surface of a transparent polystyrene film having a thickness of 50 μm, providing an adhesive layer thereon and a separating paper to prepare a release paper-attached adhesive label, printing a bar code on the surface opposite to the aluminum deposited surface, half-cutting. The peripheral portion, and making a through-hole at the center.

The abrasive tape for a magnetic information reading apparatus for photographic use of the present invention is used for reducing errors in reading magnetic information caused by stains of an apparatus having a magnetic information reading means. The apparatus is used during photographing on a silver halide photosensitive material in a camera and during printing process of a negative photosensitive material developed after taking photographs.

Thus, abrasion can be performed by the abrasive tape, to clean a magnetic information reading apparatus, for photographic use of the present invention as follows: The abrasive tape is accommodated into a cartrigde or the aforementioned specific package instead of a silver halide photographic film, and it is set into a camera. The camera is driven in a manner same as that for taking photographs. Abrasion can be performed plural times within a camera. If abrasion is performed, for example, once per 100 films, it is always possible to take photographs without reading errors. Moreover, the tape can be effectively used for the maintenance of cameras which were left in places with high humidity or on the summer beach or the like. In printing process of a negative photosensitive material, errors in reading magnetic information reading can also be reduced, by joining the tip end of the negative film with the abrasive tape for a magnetic information reading apparatus for photographic use, and by performing abrasion substantially before printing is started. Further, it is preferred that the abrasive tape be used also after the printing operation.

It is preferred that a hydrophilic colloid layer is provided on the support so that the abrasive layer and the hydrophilic colloid layer be respectively formed on a different side of the support. The hydrophilic colloid layer includes, for example, a layer containing gelatin. The layer containing gelatin may be a non-light sensitive layer containing no silver halide, or may a light sensitive layer containing silver halide. The light sensitive layer may contain any additive necessary for a color light sensitive material, for example, a coupler or plasticizer such as oil, as well as silver halide, as disclosed in EP-436938A.

The layer containing gelatin may a light sensitive monolayer or multilayer structure which contains silver halide. In this case, the art for and the organic or inorganic material for forming the light sensitive layer may be used which are disclosed in EP-436,938A2.

The abrasive tape of the invention may have a magnetic recording layer for recording any type of information. A ferromagnetic material for it may be any type which is used in the art. The magnetic recording layer can be provided on the abrasive layer; on the hydrophilic colloid layer; or on a protective layer or a top layer on the hydrophilic colloid layer. The magnetic recording layer is preferably provided on the abrasive layer. It may be formed by coating or printing. Furthermore, a light sensitive layer for recording any type of information may be provided to the abrasive tape; or a space relating to optically recording or reading, such as a space for recording a bar code may be provided to the tape. The abrasive may optionally have perforations. The perforations may be along one long end of the tape, or along two long ends of the tape.

The aforementioned silver halide photosensitive materials may be those which are prepared by forming a magnetic layer on currently available photosensitive materials on the market as well as photosensitive materials to which a magnetic recording layer is applied, wherein techniques relevant to published silver halide photosensitive materials are appropriately introduced.

An example of such photosensitive material is described below.

The technology and inorganic/organic materials which may be used in the above photosensitive material are described in EP-436,938-A2 at several parts specified below or in the patents described below.

1. Layer structure:
   page 146, line 34—page 147, line 25
2. Silver halide emulsion:
   page 147, line 26—page 148, line 12
3. Yellow coupler:
   page 137, line 35—page 146, line 33
   page 149, line 21–23
4. Magenta coupler:
   page 149, lines 24–28;
   EP-421,453-A1 (page 3, line 5—page 25, line 55)
5. Cyan coupler:
   page 149, lines 29–33;
   EP-432,804-A2 (page 3, line 28—page 40, line 2)
6. Polymer coupler:
   page 149, lines 34–38;
   EP-435,334-A2 (page 113, line 39—page 123, line 37)

7. Colored coupler:
page 53, line 42—page 137, line 34,
page 149, lines 39–45
8. Other functional couplers:
page 7, line 1—page 53, line 41,
page 149, line 46—page 150, line 3;
EP-435,334-A2 (page 3, line 1—page 29, line 50)
9. Preservatives/fungicides:
page 150, lines 25–28
10. Formalin scavengers:
page 149, lines 15–17
11. Other additives:
page 153, lines 38–47;
EP-421,453-A1 (page 75, line 21—page 84, line 56, page 27, line 40—page 37, line 40)
12. Dispersing method:
page 150, lines 4–24
13. Support:
page 150, lines 32–34
14. Film thickness and film properties:
page 150, lines 35–49
15. Color developing procedure:
page 150, line 50—page 151, line 47
16. Desilvering step:
page 151, line 48—page 152, line 53
17. Automated developer:
page 152, line 54—page 153, line 2
18. Washing and stabilizing steps:
page 153, lines 3–37.

For silver halide photosensitive materials having a magnetic recording layer, photosensitive materials and cartridges to which the following techniques are applied can be used.

Silver halide photosensitive materials having a magnetic information record layer thereon can be prepared using a thin polyester film support which is pretreated with heat and is disclosed in JP-A-6-35118, JP-A-6-17528, and Hatsumei Kyokai Kokai Giho 94-6023. Specific examples of the polyester support include that made of polyethylene aromatic dicarboxylate support having a thickness from 50 to 300 μm, preferably from 50 to 200 μm, more preferably from 80 to 115 μm, and particularly preferably from 85 to 105 μm. The support is annealed at a temperature not higher than the glass transition temperature for 1 to 1,500 hours. Subsequently, a variety of treatments may be performed which include the UV-irradiation described in JP-B-43-2603, JP-B-43-2604, JP-B-45-3828; the corona discharge treatment described in JP-B-48-5043 and JP-A-51-1316576; glow discharge treatment described in JP-B-46-43480; and undercoating described in U.S. Pat. No. 5,326,689. If desired, an underlayer may be formed which is described in U.S. Pat. No. 2,761,791. Subsequently, ferromagnetic particles described in JP-A-59-23505, JP-A-4-195,726 and JP-A-6-59357 are applied by coating.

The magnetic layer may be in a strip shape as described in JP-A-124,642 and JP-A-4-124,645.

If necessary, antistatic treatment described in JP-A-4-62, 543 may be performed. Lastly, a silver halide emulsion is applied by coating.

The silver halide emulsion is disclosed in JP-A-4-166, 932, JP-A-3-41,435, and JP-A-3-41,437.

The thus prepared photosensitive materials are preferably manufactured by a manufacturing/controlling method described in JP-A-86,817. Also, manufacture data are preferably recorded according to the method disclosed in JP-B-6-87,416. Before or after this step according to JP=A=4-125560, the photosensitive films are cut to a size narrower than the conventional 135 size, so as to match a format display having a size smaller than that of conventional ones. Also, 2 perforations are made at one side per small format display.

The thus obtained film is set in a cartrigde package described in JP-A-4-157,459, a cartrigde described in Example 9 of JP-A-5-210,202, or a film cartrigde described in U.S. Pat. No. 4,834,308, U.S. Pat. No. 4,834,366, U.S. Pat. No. 5,226,613, and U.S. Pat. No. 4,846,418.

The film cartridge used in the present invention is preferably of the type in which a flap is accommodated as disclosed in U.S. Pat. No. 4,848,89, and U.S. Pat. No. 5,317,355, in the light of the property of shutting out light.

Moreover, cartridges having a lock mechanism as described in U.S. Pat. No. 5,296,886, cartridges which display the status of use as described in U.S. Pat. No. 5,347,334, and cartridges having double exposure prevention mechanism are preferred.

It is also possible to use cartridges in which a film can be easily placed in position by only inserting the film into the cartrigde, as in JP=A-6-85128.

The thus-made film cartridges can be used in a variety of ways for enjoying photographs including taking photos and developing them according to the purpose, by using cameras, developers, and laboratory apparatuses described below.

For example, the film cartridges may be used in ready-to-charge cameras described in JP-A-6-8,886 and JP-A-6-99,908, cameras with an automated advancing mechanism described in JP-A-6-57,398 and JP-A-6-101,135, cameras described in JP-A-6-205,690 which permit the loaded film to be taken out of the camera for exchange before the film has been used up, cameras described in JP-A-5-283,382 which is capable of magnetically recording the information on photographing such as information showing an image obtained by panoramic photographing, high-vision photographing, or ordinary photographing (magnetically recorded information allowing selection of a aspect ratio for print), cameras described in JP-A-6-101,194 which has a double exposure prevention mechanism, and cameras described in JP-A-5-150,577 which has a mechanism for displaying the status of use of film or the like. Particularly in the above cases, the film cartrigde exhibit its excellent functions.

Films which have been photographed in the above combination uses are processed with an automated developing machine described in JP-A-6-222,514 and JP-A-222,545. Before, during, or after the developing process, a method of utilizing magnetic records on films as described in JP-A-6-95,265 and JP-A-4-123,054 may be used. Also, the aspect ratio selection mechanism described in JP-A-5-19,364 may be employed.

When cinematic developing is performed at the time of developing, the splicing method described in JP-A-5-119, 461 may be used.

During or after the developing process, the attaching or detaching treatment described in JP-A-6-148,805 may be performed.

After the films are thus treated, it is possible to convert the information contained in the films into prints, through back-printing or front printing to color paper, by a method described in JP-A-2-184,835, JP-A-186,335, or particularly JP-A-6-79,968.

Moreover, it is also possible to return the film to the customer along with index prints and the returning cartrigde described in JP-A-5-11,353 and JP-A-5-232,594.

EXAMPLES

The present invention will next be described in detail by way of examples. It is apparent to persons with ordinary skill in the art that the components, proportion, operation procedure, and the like can be modified within the scope of the invention. Therefore, the present invention should not be construed as being limited to only the below-described Examples. In Examples, "part(s)" means "part(s) by weight".

On each of supports made of polyethylene terephthalate (PET) having thicknesses of 55 μm, 75 μm, and 200 μm, an undercoat layer (thickness: 0.1 μm) made of a polyester polyurethane resin was formed. Separately, the below-described composition was dispersed by using glass bead dispersant media in a sand grinder for 6 hours to prepare a coating liquid for forming an abrasive layer. The coating liquid was applied by a bar coat method so that the thickness after being dried would be 15 μm, followed by drying, obtaining abrasive tape samples.

| Composition of the coating liquid | Part(s) |
|---|---|
| Abrasive particles (chromium oxide, Mohs hardness: 8, average particle size: 1 μm) | 100 |
| Binder resin (polyester polyurethane, sodium sulfonate $1 \times 10^{-3}$ equivalent/g resin, MW: 70,000) | 8 |
| Polyisocyanate (a TDI (3 mols) adduct of trimethylolpropane (1 mol)) | 2 |
| Lubricant (oleic acid/oleyl oleate) | 0.1 |
| Diluent (methylethylketone/cyclohexanone = 2:1) | 200 |
| Diluent (toluene/MIBK) | 150 |
| Additive (carbon black) | 2 |

The three kinds of the abrasive tapes were cut to 24 mm in width×160 cm in length. Along one long side of the tape, two 2 mm×2 mm square perforations were formed at the position 0.7 mm from the edge of the long side, with an interval of 5.8 mm. Such pair of perforations were made at intervals of 32 mm. The resulting tape was loaded in a plastic film-cartrigde suitable for the invention, as described suitable for the invention with reference to FIGS. 1 to 7.

The essential materials for making the cartrigde were as follows.

For upper and lower cases 105 and 106: Polystyrene kneaded together with black carbon for shielding light.

For spool shaft 112: —do.—

Lid member 108: —do.—

Flanges 113, 114: Polycarbonate

On the other hand, photosensitive materials were prepared as described below.

1) Support:

The support used in this Example was prepared by the following method.

100 parts by weight of polyethylene-2,6-naphthalate polymer and 2 parts by weight of Tinuvin P. 326 (manufactured by Chiba-Geigy, a UV absorber) were dried and melted at 300° C. The melt was extruded from a T-shape die, and stretched in a longitudinal direction with a factor 3.3 at 1400° C. Subsequently, stretching in a transversal direction with a factor 3.3 was performed at 130° C. Then, the stretched material underwent thermosetting at 250° C. for 6 seconds. A PEN film having a thickness of 90 μm was obtained. Suitable amounts of blue dyes, magenta dyes, and yellow dyes (I-1, I-4, I-6, I-24, I-26, I-27, II-5 described in Kokai Giho, No. 94-6023) were added to the PEN film. The film was wound on a stainless steel rod having a diameter of 20 cm, and then heated at 110° C. for 48 hours to make a support which will not have resistance against curl.

2) Undercoat layer:

The supports obtained in the above process were subjected to corona discharge treatment, UV discharge treatment, and glow discharge treatment on their both sides. On a surface of respective supports an undercoat liquid having the following composition was applied: 0.1 g/m$^2$ of gelatin, 0.01 g/m$^2$ of sodium a-sulfodi-2-ethylhexyl succinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$, and 0.02 g/m$^2$ of polyamide-epichlorohydrin polycondensation product. The amount of the application was 10 cc/m$^2$, and a bar coater was used. Thus, an undercoat layer was provided on the side heated to high temperature, during stretching, of each support. It was dried at 115° C. for 6 minutes (the rollers and conveying means at the drying zone were all at 115° C.).

3) Backing layer:

On the undercoated side of the resulting support, an antistatic layer, a magnetic recording layer, and a slipping layer described below were provided.

3-1) Antistatic layer:

Dispersant of 0.2 g/m$^2$ of a fine powder of tin oxide-antimony oxide complex having an average particle size of 0.005 μm and a specific resistance of 5 Ω.cm (diameter of secondary cohesion powder: about 0.08 μm) was applied to the above, together with 0.05 g/m$^2$ of gelatin, 0.02 g/m$^2$ of $(CH_2{=}CHSO_2CH_2CH_2NHCO)_2CH_2$, 0.005 g/m$^2$ of poly (polymerization degree: 10)oxyethylene-p-nonylphenol and resorcin.

3-2) Magnetic recording layer:

0.06 g/m$^2$ of Cobalt-gamma-iron oxide coated with 3-poly(polymerization degree: 15)oxyethylenepropyloxytrimethoxysilane (15% by weight) was used (specific surface area: 43 m$^2$/g, long axis: 0.14 μm, short axis: 0.03 μm, saturated magnetization: 89 emu/g, $Fe^{+2}/Fe^{+3}$=6/94, the surface was treated with 2% by weight of aluminum oxide/silicon oxide, with respect to the weight of the iron oxide) was blended with 1.2 g/m$^2$ of diacetylcellulose (iron oxide was dispersed using an open kneader and a sand mill), 0.3 g/m$^2$ of a setting agent, $C_2H_5C(CH_2OCONH{-}C_6H_3(CH_3)NCO)_3$, and solvents (acetone, methylethyl ketone, and cyclohexanone). The blend was applied to the above to form a magnetic recording layer having a thickness of 1.2 μm by using a bar coater. As a matting agent, silica particles (0.3 μm) and an abrasive agent, i.e., aluminum oxide coated with 3-poly (polymerization degree: 15)oxyethylenepropyloxytrimethoxysilane (15% by weight), were added thereinto in respective amounts of 10 mg/m$^2$. The resulting material was dried at 115° C. for 6 minutes (the rollers and conveying means at the drying zone were all at 115° C.). The color density increment of $D^B$ of the magnetic recording layer obtained when an X-lite (blue filter) was used was about 0.1. The saturated magnetic moment was 4.2 emu/g, the coercive force was $7.3\times10^4$ A/m, and the ratio of rectangular area was 65%.

3-3) Slipping layer:

A mixture of diacetylcellulose (25 mg/m$^2$) and $C_6H_{13}CH(OH)C_{10}H_{20}COOC_{40}H_{81}$ (6 mg/m$^2$) was applied to the above resultant. This mixture was melted in xylene/propylene monomethylether (1/1) at 105° C., and poured into propylene monomethylether (10 times by volume) at ambient temperature for dispersion, and subsequently was further dispersed in acetone (average particle size: 0.01 μm).

Further, in the mixture, as a matting agent, silica particles (0.3 μm) and an abrasive agent, aluminum oxide coated with 3-poly(polymerization degree: 15)oxyethylene-propyloxytrimethoxysilane (154 by weight), were added in respective amounts of 15 mg/m$^2$. The resulting applied material was dried at 115° C. for 6 minutes (the rollers and conveying means at the drying zone were all at 115° C.). The slipping layer had a coefficient of dynamic friction of 0.09 (stainless steel balls having a diameter of 5 mm, load: 100 g, speed: 1 mm/sec) and a coefficient of static friction of 0.07 (clipping method). It has a good coefficient of dynamic friction of 0.12 on the side of the emulsion layer (which will be described below).

4) Photosensitive layer:

On the side opposite to the backing layer obtained in the above-described procedure, a plurality of layers having the same composition as sample 127 in Example 1 of JP-A-6-337,505 were formed to prepare a color negative film.

This photosensitive material was cut to a size of 24 mm in width×160 cm. The same perforations as those described above were formed. The resulting tape was accommodated in the same cartrigde as above.

On the resultant sample, FM signals were recorded, at a transmitting speed of 1,000/s between each perforation formed in each photosensitive material by a head. The head gap was 5 μm from the surface onto which the magnetic recording layer was applied. The head employed was capable of both inputting and outputting and had 2,000 turns. Magnetic information was input in accordance with the format described in WO90-04205.

A camera, Zoomcaldia (manufactured by Fuji Photo Film Co., Ltd.) was reconstructed so as to permit the cartrigde to be loaded therein. Numbers from 1 to 1000 were put onto the cartridges, and photographs were taken by using the cartridge.

After No. 1000 had been photographed, the film was replaced by the previously prepared cartrigde containing an abrasive tape having a support thickness of 55 μm, to perform cleaning in the same manner as photographing.

After completion of cleaning operation with the abrasive tape, a No. 1001 photosensitive material was loaded in the camera to continue photographing.

After photographing was finished, No. 1, No. 1000, and No. 1001 photosensitive materials were evaluated in terms of output errors.

Next, the camera was changed to a different one, and similar photographing was performed by using photosensitive materials Nos. 2001 to 3000. Subsequently, the material was replaced by a cartrigde containing an abrasive tape having a support thickness of 75 μm, to perform cleaning in the same manner as that described above.

After completion of the cleaning operation with the abrasive tape, a No. 3001 photosensitive material was loaded and the photographing was continued. In the same manner, photosensitive materials Nos. 2001, 3000 and 3001 were evaluated in terms of output errors.

The camera was changed again. Photosensitive material Nos. 4001 to 5000 were used for photographing by the camera. Thereafter, the film cartridges were replaced by a cartrigde containing an abrasive tape having a support thickness of 200 μm. In this case, the camera did not work. The cause for it was investigated. Then it was found that the abrasive tapes came out of cartridges difficultly, and that after they were pulled by force, operation of the camera was tried so that the tape could not be advanced. Thus, it was concluded that the total thickness of the abrasive tape was excessively great.

Further, abrasive tapes were prepared in which only an average abrasive particle size was changed from 1.0 μm to 5.0 μm, and the support thicknesses were 55 μm and 75 μm. They were subjected to a similar testing. Using the photosensitive materials Nos. 6001, 7000, 7001, as well as 8001, 9000, and 9001, their output errors were evaluated.

TABLE 1

| No. of photo-sensitive material cartridges | Support thickness of abrasive tapes [μm] | Average particle size of abrasive [μm] | Number of reading errors | Remarks |
|---|---|---|---|---|
| 1 | | | 0 | Comp. Ex., No abrasive tape was used |
| 1000 | 55 | 1.0 | 27 | Comp. Ex., No abrasive tape was used |
| 1001 | | | 8 | Comp. Ex., Abrasive tape was used immediately before |
| 2001 | | | 0 | Comp. Ex., No abrasive tape was used |
| 3000 | 75 | 1.0 | 27 | Comp. Ex., No abrasive tape was used |
| 3001 | | | 0 | Invention, Abrasive tape was used immediately before |
| 4001 | | | — | Comp.. Ex., Camera did not work |
| 5000 | 200 | 1.0 | — | Comp.. Ex., Camera did not work |
| 5001 | | | — | Comp.. Ex., Camera did not work |
| 6001 | | | 0 | Comp. Ex., No abrasive tape was used |
| 7000 | 55 | 5.0 | 27 | Comp. Ex., No abrasive tape was used |
| 7001 | | | 8 | Comp. Ex. Abrasive tape was used immediately before |
| 8001 | | | 0 | Comp. Ex., No abrasive tape was used |
| 9000 | 75 | 5.0 | 27 | Comp. Ex., No abrasive tape was used |
| 9001 | | | 0 | Invention, Abrasive tape was used immediately before |

As shown in Table 1, when abrasive tapes having supports with thicknesses in the range of the present invention. i.e., 55 μm and 75 μm, were used after photographing 100 rolls of photosensitive materials, and then photosensitive materials were photographed again, errors in reading the recorded magnetic information was clearly reduced.

When the support thickness was 55 μm, stains could not be removed sufficiently. Therefore, reading errors were not zero, although they were significantly reduced. By contrast, when the support thickness was 75 μm (which is in the range of 70–120 μm), no reading error occurred, and it was quite the same as in the case wherein a first photo is taken with, a new camera. Thus, this thickness is particularly preferable. Moreover, when the support thickness was 200 μm, cameras did not work. Thus, the tapes were not suitable for abrasive tapes for photographic use.

In the present invention, the average particle sizes of the abrasive were 1.0 μm and 5.0 μm. However, in the above test, no difference was found between the two cases.

EXAMPLE 2

Using the photosensitive materials used in Example 1, similar cartridges were made. After being subjected to photographing in a similar manner, they were developed with an automatic developer, FP-360B (manufactured by Fuji Photo Film. Co., Ltd.). Using 50 developed photosensitive materials, the magnetic information recorded thereon was read through a color printer equipped with a magnetic information reading apparatus. After processing the 50 materials, an abrasive tape prepared in Example 1 (support thickness: 55 μm, average particle size of abrasive: 1.0 μm, the length was the same, i.e, 160 cm) was passed through the printer. Again, the magnetic information was read about photosensitive materials Nos. 50 and 51. They were evaluated together with the first photosensitive material, No. 1 in terms of reading errors.

Next, experiments as above were repeated while the exchanged abrasive tape was used for cleaning at intervals in a manner similar to that described in Example 1. However, the contact portion of the magnetic information reading apparatus where the photosensitive materials came into contact was carefully washed, polished, and cleaned before performing the new test.

When abrasive tapes having a support thickness of 200 um were used, they did not pass through the printer as in the case in Example 1, and the samples were not conveyed in an automated manner. Thus, these cases were excluded from the test results.

The result are shown in Table 2.

TABLE 2

| No. of processed sensitive materials | Support thickness of abrasive tapes [μm] | Average particle size of abrasive [μm] | Number of reading errors | Remarks |
|---|---|---|---|---|
| 1 | | | 0 | Comp. Ex., No abrasive tape was used |
| 50 | 55 | 1.0 | 43 | Comp. Ex., No abrasive tape was used |
| 51 | | | 12 | Comp. Ex., Abrasive tape was used immediately before |
| 101 | | | 0 | Comp. Ex., No abrasive tape was used |
| 150 | 75 | 1.0 | 43 | Comp. Ex., No abrasive tape was used |
| 151 | | | 0 | Invention, Abrasive tape was used immediately before |

TABLE 2-continued

| No. of processed sensitive materials | Support thickness of abrasive tapes [μm] | Average particle size of abrasive [μm] | Number of reading errors | Remarks |
|---|---|---|---|---|
| 201 | | | — | Comp. Ex., Automated transferring was difficult |
| 250 | 200 | 1.0 | — | Comp. Ex., Automated transferring was difficult |
| 251 | | | — | Comp. Ex., Automated transferring was difficult |
| 301 | | | 0 | Comp. Ex., No abrasive tape was used |
| 350 | 55 | 5.0 | 43 | Comp. Ex., No abrasive tape was used |
| 351 | | | 11 | Comp Ex., Abrasive tape was used immediately before |
| 401 | | | 0 | Comp. Ex., No abrasive tape was used |
| 450 | 75 | 5.0 | 43 | Comp. Ex., No abrasive tape was used |
| 451 | | | 0 | Invention, Abrasive tape was used immediately before |

As shown in Table 2, when abrasive tapes having supports with a thickness of 75 μm were used after passing 50 photosensitive materials through a printer, and then these the printer was operated again, errors in reading the recorded magnetic information was avoided.

In addition, it was found that even when the thickness of the supports in the abrasive tapes was 55 μm (which is within the range of the present invention), sufficient contact for effecting abrasion could not be obtained. Therefore, reading errors were not perfectly eliminated. Thus, a support thick of 75 μm is more preferable than 55 μm. When the support thickness was 200 μm, the abrasive tapes were difficult to be conveyed inside the printer. Thus, this thickness should not be used.

No significant difference was found between the two average particle sizes of the abrasive, 1.0 μm and 5.0 μm. Both clearly provided good effects.

EXAMPLE 3

The composition of the support for the abrasive tapes used in Example 1 was changed to cellulose triacetate (TAC), and the support thickness was changed to 120 μm. The coating components remained the same. The resulting abrasive sheets were cut to the size same as that in Example 1, and perforations were formed to make abrasive tapes.

The abrasive tapes were passed through a printer equipped with a magnetic information reading apparatus in a manner similar to that employed in Example 2. Reading errors were evaluated.

As a result, results similar to those of photosensitive material Nos. 101, 150, and 151 in Table 2 (Example 2) were obtained. Thus, it was found that when abrasive tapes were passed through a printer after many developed photosensitive materials were passed through it, and photosensitive materials were passed through it again, reading errors were eliminated.

EXAMPLE 4

An undercoat layer was provided on a support of polyethylene-2,6-dinaphthalate (thickness: 95 μm), and then a gelatin layer and a protective layer having the following compositions were provided thereon.

| | |
|---|---|
| Gelatin layer: | |
| gelatin | 10.0 g/m$^2$ |
| Protective layer: | |
| Gelatin | 0.7 g/m$^2$ |
| Polymethyl acrylate (2.0 μm) | 0.050 g/m$^2$ |
| Polydimethyl siloxane (molecular weight: 30000) | 0.100 g/m$^2$ |
| The following compound | 0.020 g/m$^2$ |

$$C_8F_{17}SO_2\underset{\underset{C_3H_7}{|}}{N}CH_2COOH$$

A coating liquid for an abrasive layer prepared from the following composition was applied to the side of the support different from the side thereof having the gelatin layer and the protective layer, by bar coating, so that the abrasive layer would have thickness of 10 μm after dry. Thus, a sample was prepared.

| Abrasive layer: | |
|---|---|
| Abrasive (Alumina, WA) | 100 parts |
| Binder (Polyester Polyurethan resin containing 2 × $10^{-3}$ equivalents of sodium sulphonate per g of the resin, and 1 × $10^{-5}$ equivalents of epoxy groups per g of the resin. molecular weight: 70000) | 10 parts |
| Binder (Polyisocyanate, adduct obtained by adding 3 moles of TDI to 1 mole of trimethylol propane) | 5 parts |
| Diluent (Methyl ethyl ketone/cyclohexanone = 2/1) | 200 parts |
| Diluent(Toluene/MIBK) | 150 parts |
| Additive (Carbon black) | 10 parts |

The obtained tape was slit to a respective width of 24 mm. The resultants were subjected to various head treatments. The results are shown in Table 3.

In the table, WA2000, WA4000 and WA8000 respectively represent alumina. Mohs hardness of the abrasives are shown in Table 1.

Measuring method:

Ra: it was measured by using Talistep (ex. Rark Tayler Hobson).

dB: It corresponds to an output value after cleaning the head. The playback level of signals was obtained when 100 light sensitive materials were subject to the magnetic head treatment and then stains on the head were cleaned with the sample of 1 m. The level was represented by dB, based on the playback level before the treatment.

Table 3 demonstrates that when the abrasive tapes of I-1 to I-6 were used, the playback level of signals after cleaning the heads was the same as that before the cleaning, and the cleaning effect by the abrasive tape was superior.

TABLE 3

| Sample | Abrasive | Mohs hardness | Ra(μm) | dB |
|---|---|---|---|---|
| C-1 | non | — | 0.02 | −6 or less |
| C-2 | WA2000 | 9.0 | 0.8 | −6 or less |
| I-1 | WA4000 | 9.0 | 0.4 | 0 |
| I-2 | WA6000 | 9.0 | 0.2 | 0 |
| I-3 | WA8000 | 9.0 | 0.1 | 0 |
| I-4 | chromium oxide | 8.0 | 0.4 | 0 |
| I-5 | chromium oxide | 8.0 | 0.2 | 0 |
| I-6 | chromium oxide | 8.0 | 0.1 | 0 |

C-1 and C-2: Comparative samples
I-1–I-6: Samples of the present invention

What is claimed is:

1. An abrasive tape for a magnetic information reading apparatus for photographic use comprising:

a support tape having a thickness between 60 μm and 180 μm;

an abrasive layer comprising an abrasive and a binder provided on one side of the support tape;

a hydrophilic colloid layer provided on another side of the support opposite the one side upon which the abrasive layer is provided.

2. The abrasive tape according to claim 1, wherein the range of the surface roughness $R_a$ defined in Japanese Industrial Standards B 0601-1994 is from 0.05 to 0.6 μm.

3. The abrasive tape according to claim 1, wherein the abrasive has a Mohs hardness of not less than 5.

4. The abrasive tape according to claim 1, wherein the abrasive is selected from the group consisting of iron oxide, alumina, chromium oxide, silicon carbide and diamond.

5. The abrasive tape according to claim 1, wherein the abrasive has an average particle size from 0.1 to 10 μm.

6. The abrasive tape according to claim 1, wherein from 5 to 700 parts by weight of the binder is used per 100 parts by weight of the abrasive.

7. The abrasive tape according to claim 1, having a thickness from 60.5 to 210 μm.

8. A method for cleaning a magnetic information reading apparatus for photographic use, comprising the step of cleaning the apparatus with the abrasive tape according to claim 1.

9. The abrasive tape according to claim 1, wherein said support tape has a thickness between 60 μm and 150 μm.

10. A method for cleaning a magnetic head of a photosensitive photograph apparatus, comprising the steps of installing the abrasive tape according to claim 9 in the photosensitive photography apparatus, and running said abrasive tape against the magnetic head of said apparatus.

11. The abrasive tape according to claim 1, wherein said support tape has a thickness between 75 μm and 180 μm.

* * * * *